US008772666B2

(12) United States Patent
Darko et al.

(10) Patent No.: US 8,772,666 B2
(45) Date of Patent: Jul. 8, 2014

(54) INTERLOCK SYSTEM FOR SWITCHGEAR

(75) Inventors: Kennedy Amoako Darko, Bolingbrook, IL (US); Donald Richard Martin, New Lenox, IL (US)

(73) Assignee: G & W Electric Company, Bolingbrook, IL (US)

( * ) Notice: Subject to any disclaimer, the term of this patent is extended or adjusted under 35 U.S.C. 154(b) by 236 days.

(21) Appl. No.: 13/476,529

(22) Filed: May 21, 2012

(65) Prior Publication Data

US 2013/0206554 A1 Aug. 15, 2013

Related U.S. Application Data

(60) Provisional application No. 61/633,430, filed on Feb. 9, 2012.

(51) Int. Cl.
*H01H 3/00* (2006.01)

(52) U.S. Cl.
USPC ..... 218/154; 218/120; 218/140

(58) Field of Classification Search
USPC ..... 218/118–120, 140, 154
See application file for complete search history.

(56) References Cited

U.S. PATENT DOCUMENTS

| | | | | |
|---|---|---|---|---|
| 4,484,046 | A | 11/1984 | Neuhouser | |
| 5,929,405 | A * | 7/1999 | Wehrli et al. | 200/50.01 |
| 5,955,716 | A * | 9/1999 | Thuries et al. | 218/154 |
| 6,060,674 | A | 5/2000 | Malingowski et al. | |
| 6,600,124 | B1 | 7/2003 | Yamat | |
| 6,653,918 | B1 * | 11/2003 | Johnson | 335/68 |
| 7,672,108 | B2 | 3/2010 | Moninski et al. | |
| 7,679,022 | B2 | 3/2010 | Tsuchiya et al. | |
| 7,897,890 | B2 | 3/2011 | Kikukawa et al. | |
| 8,076,598 | B2 * | 12/2011 | Billard et al. | 200/50.06 |
| 8,203,088 | B2 * | 6/2012 | Gottschalk et al. | 200/50.01 |
| 2008/0258667 | A1 * | 10/2008 | Morris et al. | 318/490 |
| 2010/0122967 | A1 | 5/2010 | Morita et al. | |

OTHER PUBLICATIONS

International Search Report and Written Opinion for Application No. PCT/US2012/065275 dated Jan. 31, 2013 (7 pages).

* cited by examiner

*Primary Examiner* — Truc Nguyen
(74) *Attorney, Agent, or Firm* — Michael Best & Friedrich LLP

(57) ABSTRACT

An interlock system for a circuit-interrupting device. The circuit-interrupting device includes a gearbox, a load-breaker in series with a visible disconnect, and an assembly driving the visible disconnect between an open state and a closed state. The interlock system includes a cam and a bias-driven follower. The cam is coupled to a shaft and is driven by the shaft between a first cam state when the load-breaker is in an open state and a second cam state when the load-breaker is in a closed state. The bias-driven follower has a first follower state when the cam is in the first cam state and has a second follower state when the cam is in the second cam state. In the second follower state, the bias-driven follower blocks movement of at least one component of the assembly. The cam and the bias-driver follower are positioned inside the gearbox.

28 Claims, 15 Drawing Sheets

INTERLOCK SYSTEM FOR SWITCHGEAR

RELATED APPLICATIONS

This application claims priority to U.S. Provisional Application No. 61/633,430, filed Feb. 9, 2012, the entire contents of which are hereby incorporated by reference.

BACKGROUND

Circuit-interrupting devices (i.e., switches) include load-breakers, such as vacuum interrupters, that are used to control the flow of electricity through the switch. For example, vacuum interrupters typically include a stationary contact, a movable contact, and a mechanism for moving the movable contact. To open the electrical circuit defined by the switch, the movable contact is separated from the stationary contact.

SUMMARY

For safety precautions, a visible disconnect can be provided in series with the load-breaker to provide visual verification of whether the circuit is open. In particular, the visible disconnect can have an open state and a closed state. In the closed state, the visible disconnect physically and electrically connects the load-breaker with an electricity source (e.g., a source conductor). In the open state, the visible disconnect physically and electrically disconnects the load-breaker from the electricity source. However, to prevent unsafe arcing across the visible disconnect, the load-breaker must be opened (i.e., the movable contact must be separated from the stationary contact) to create an isolated switch before the visible disconnect can be safely opened (i.e., before the visible disconnect can be changed from the closed state to the open state). Similarly, the visible disconnect must be changed from the open state to the closed state before the load-breaker can be returned to its closed state where the movable contact is rejoined with the stationary contact.

Furthermore, in some situations, the load-breaker may malfunction. For example, an operating mechanism that allows an operator to open or close the load-breaker (e.g., separate the contacts of a vacuum interrupter) may malfunction and the movement of the operating mechanism may not be transferred to the load-breaker. Also, in some situations, the contacts of a vacuum interrupter may be subject to pre-arcing that causes the movable contact to become welded to the stationary contact. In this situation, when the welded joint is strong enough to prevent the operating mechanism from separating the contacts, the contacts will not separate even if an operator drives the operating mechanism to open the load-breaker. When the contacts do not physically separate, it is unsafe to allow an operator to change the state of the visible disconnect.

Similarly, in some situations, the switch may include safety systems (e.g., an interlock system or a triggering system) that ensure a proper operational sequence of the load-breaker and the visible disconnect. These safety systems, however, may also malfunction or may be improperly by-passed or disabled by an operator, which creates safety concerns.

Therefore, embodiments of the invention provide mechanisms for ensuring that the load-breaker is disconnected from the source conductor before an operator is able to change the state of the visible disconnect. In particular, one embodiment of the invention provides a circuit-interrupting device including a load-breaker having a first contact and a second contact, wherein the second contact is movable between a first position $P_1$ and a second position $P_2$. The circuit-interrupting device also includes a first operating mechanism for actuating movement of the second contact and a first assembly for controlling movement of the first operating mechanism. The first assembly includes a first extension movable to operate the first assembly. The device further includes a visible disconnect in series with the load-breaker, wherein the visible disconnect has an open state and a closed state. In addition, the device includes a second operating mechanism for actuating the visible disconnect between the open state and the closed state and a second assembly for controlling movement of the second operating mechanism. The second assembly includes a second extension movable to operate the second assembly. Furthermore, the device includes an interlock system that prevents movement of at least one component of the second assembly when the second contact is not in the second position $P_2$, wherein the interlock system operates independently of the first extension and the second extension.

Another embodiment of the invention provides a circuit-interrupting device comprising a gearbox, a visible disconnect, and a load-breaker in series with the visible disconnect. The circuit-interrupting device also includes a first operating mechanism for actuating the load-breaker between an open state and a closed state and a second mechanism for actuating the visible disconnect between an open state and a closed state. In addition, the device includes a first assembly controlling movement of the first operating mechanism and a second assembly controlling movement of the second operating mechanism. The device further includes an interlock system external to the gearbox and an interlock system internal to the gearbox. The external interlock system coordinates operation of the first assembly and the second assembly. The internal interlock system includes a cam and a bias-driven follower. The cam is driven by a shaft between a first cam state when the load-breaker is in the open state and a second cam state when the load-breaker is in the closed state. The bias-driven follower has a first follower state when the cam is in the first cam state and has a second follower state when the cam is in the second cam state. The bias-driven follower blocks movement of at least one component of the second assembly when the bias-driven follower is in the second follower state.

Yet another embodiment of the invention provides an interlock system for a circuit-interrupting device, the circuit-interrupting device including a gearbox, a load-breaker in series with a visible disconnect, and an assembly for driving the visible disconnect between an open state and a closed state. The interlock system includes a cam and a bias-driven follower. The cam is coupled to a shaft and is driven by the shaft between a first cam state when the load-breaker is in an open state and a second cam state when the load-breaker is in a closed state. The bias-driven follower has a first follower state when the cam is in the first cam state and has a second follower state when the cam is in the second cam state. In the second follower state, the bias-driven follower blocks movement of at least one component of the assembly. The cam and the bias-driven follower are internal to the gearbox.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
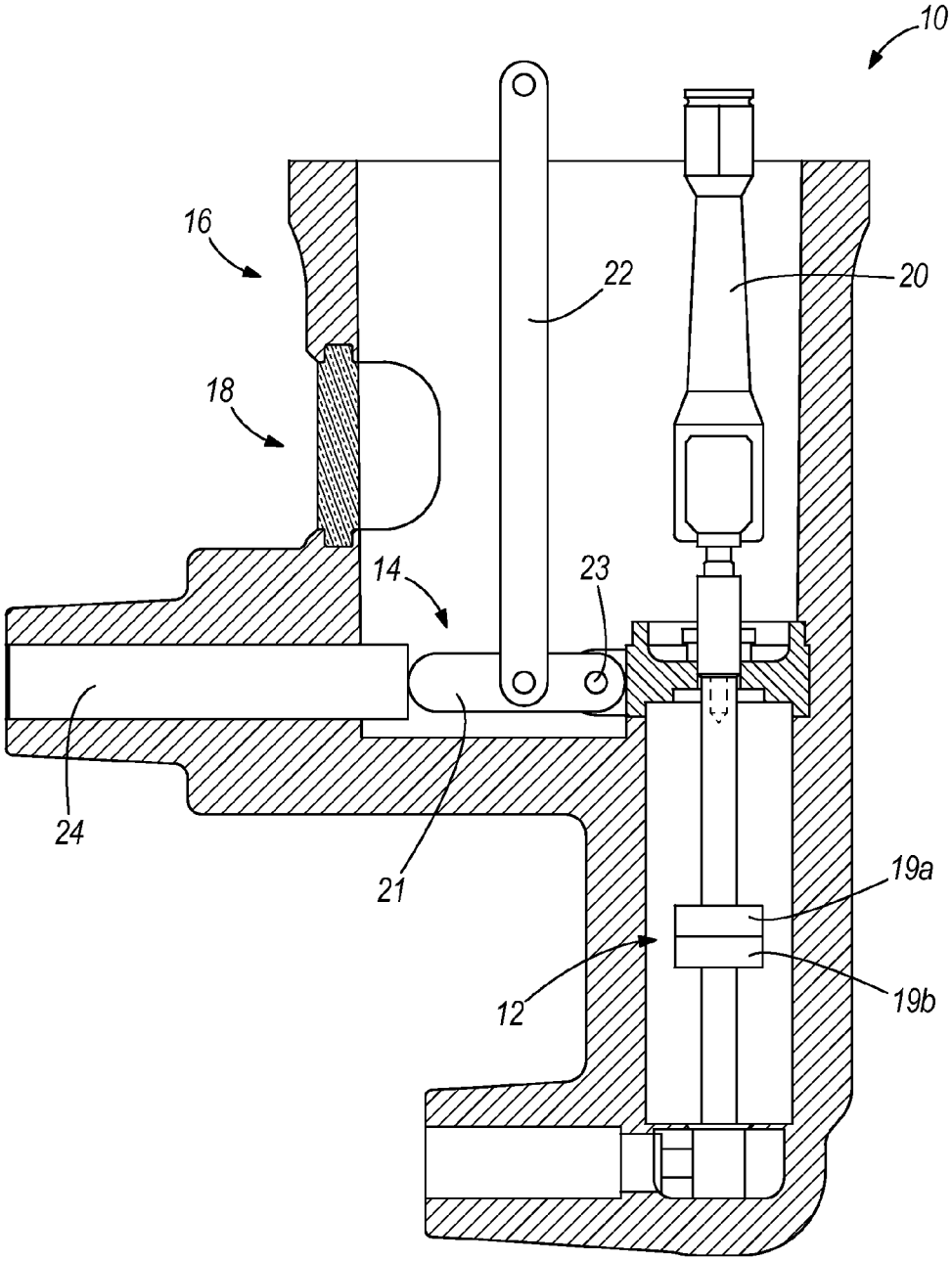
FIG. 1 is a cross-sectional view of a switch including a visible disconnect and a load-breaker, with the load-breaker and the visible disconnect shown in a closed state.
Figure 2:
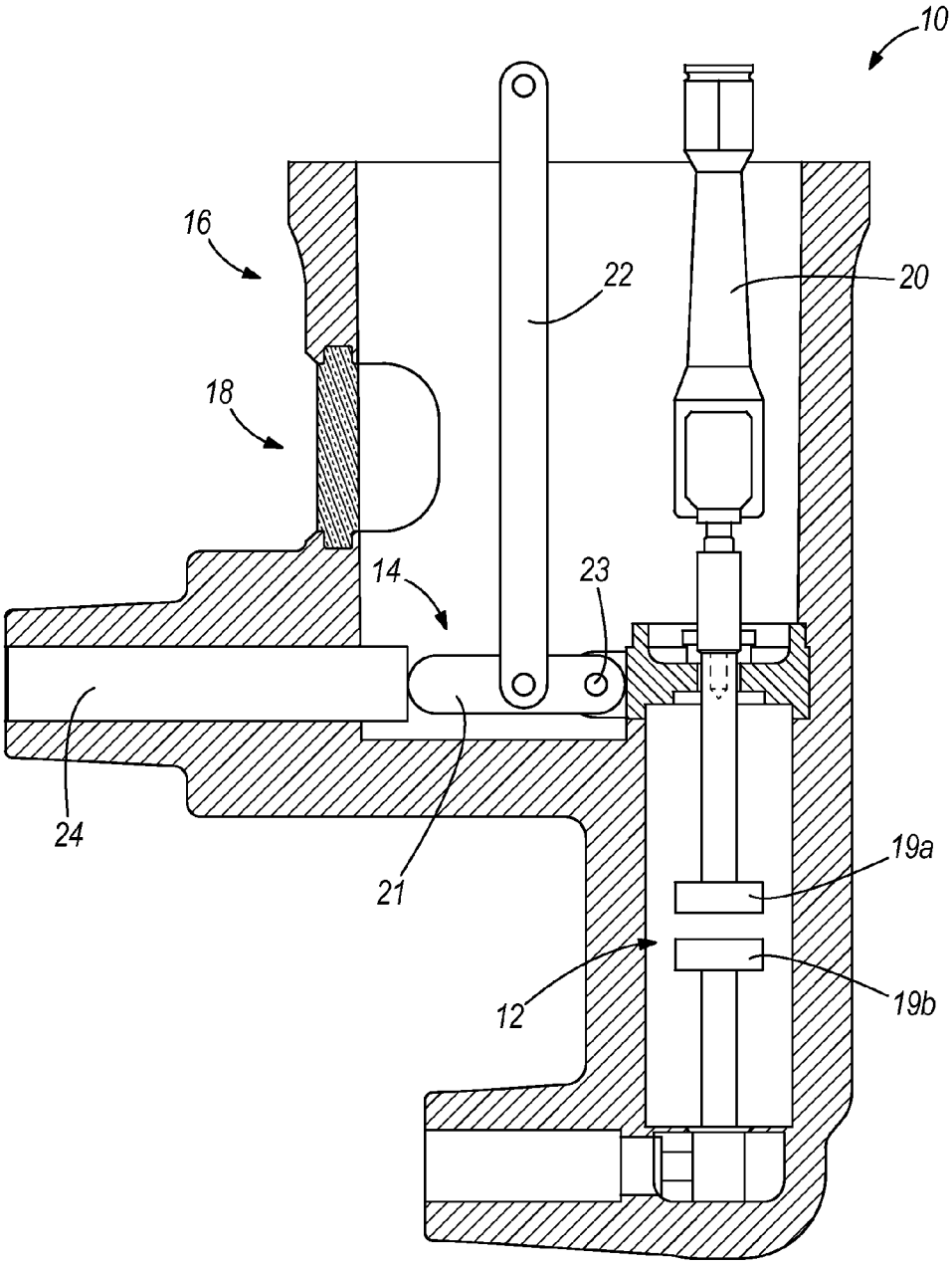
FIG. 2 is a cross-sectional view of the switch of FIG. 1, with the load-breaker shown in an open state and the visible disconnect shown in a closed state.
Figure 3:
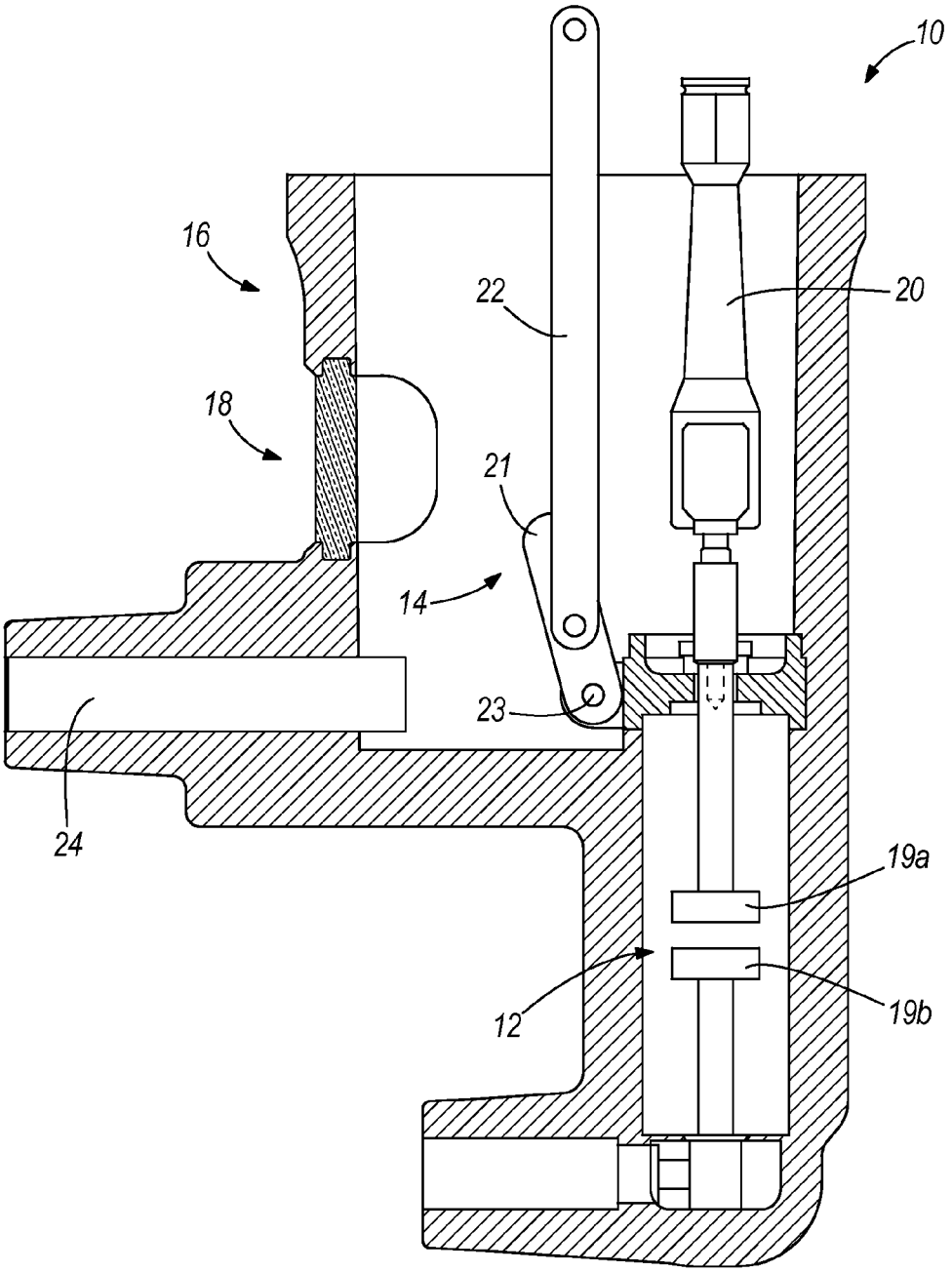
FIG. 3 is a cross-sectional view of the switch of FIG. 1, with the load-breaker and the visible disconnect shown in an open state.

FIGS. 1-3 illustrate a switch 10. The switch 10 includes a load-breaker (e.g., vacuum interrupter 12), a visible disconnect 14, a housing 16, and a generally transparent or translucent viewing window 18. The housing 16 at least partially encases the vacuum interrupter 12 and the visible disconnect 14. In some embodiments, the switch 10 includes a solid dielectric switch. In other embodiments, the switch 10 includes a gas-based or oil-based switch.

The vacuum interrupter 12 can include a first contact 19*a* and a second contact 19*b* that is movable between a first position $P_1$ and a second position $P_2$. When the second contact 19*b* is in the first position $P_1$, the contacts 19*a*, 19*b* are connected or in contact with one another (see FIG. 1), the vacuum interrupter 12 is in a closed state, and the circuit is closed. Alternatively, when the second contact 19*b* is in the second position $P_2$, the contacts 19*a*, 19*b* are not connected (see FIGS. 2 and 3), the vacuum interrupter 12 is in an open state, and the circuit is open. The state of the vacuum interrupter 12 can be changed using a vacuum interrupter operating mechanism (e.g., an actuator) 20. The vacuum interrupter operating mechanism 20 can be operated manually or in an automated fashion.

Figure 4A:
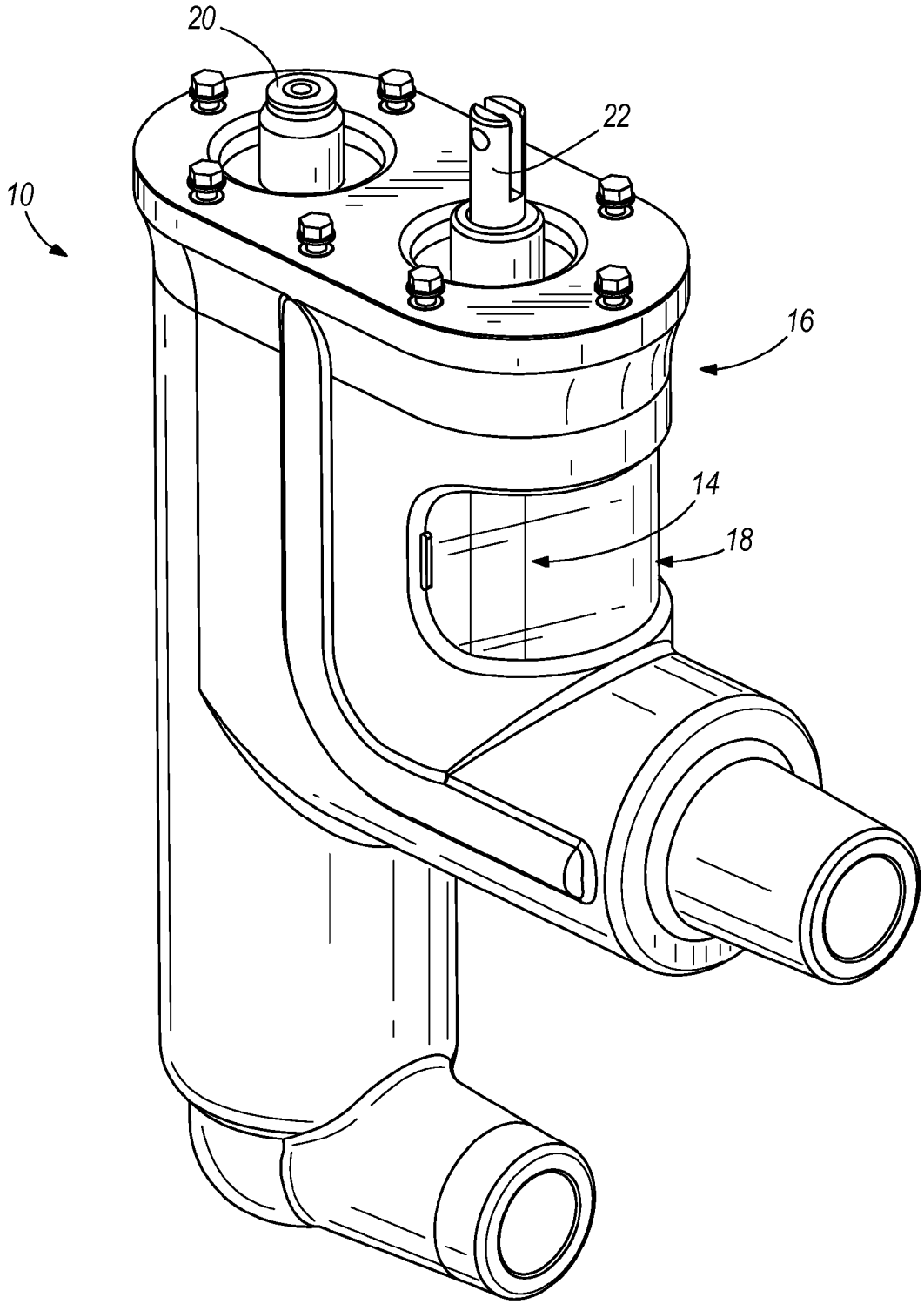
FIG. 4*a* is a perspective view of the switch of FIG. 1.
Figure 4B:
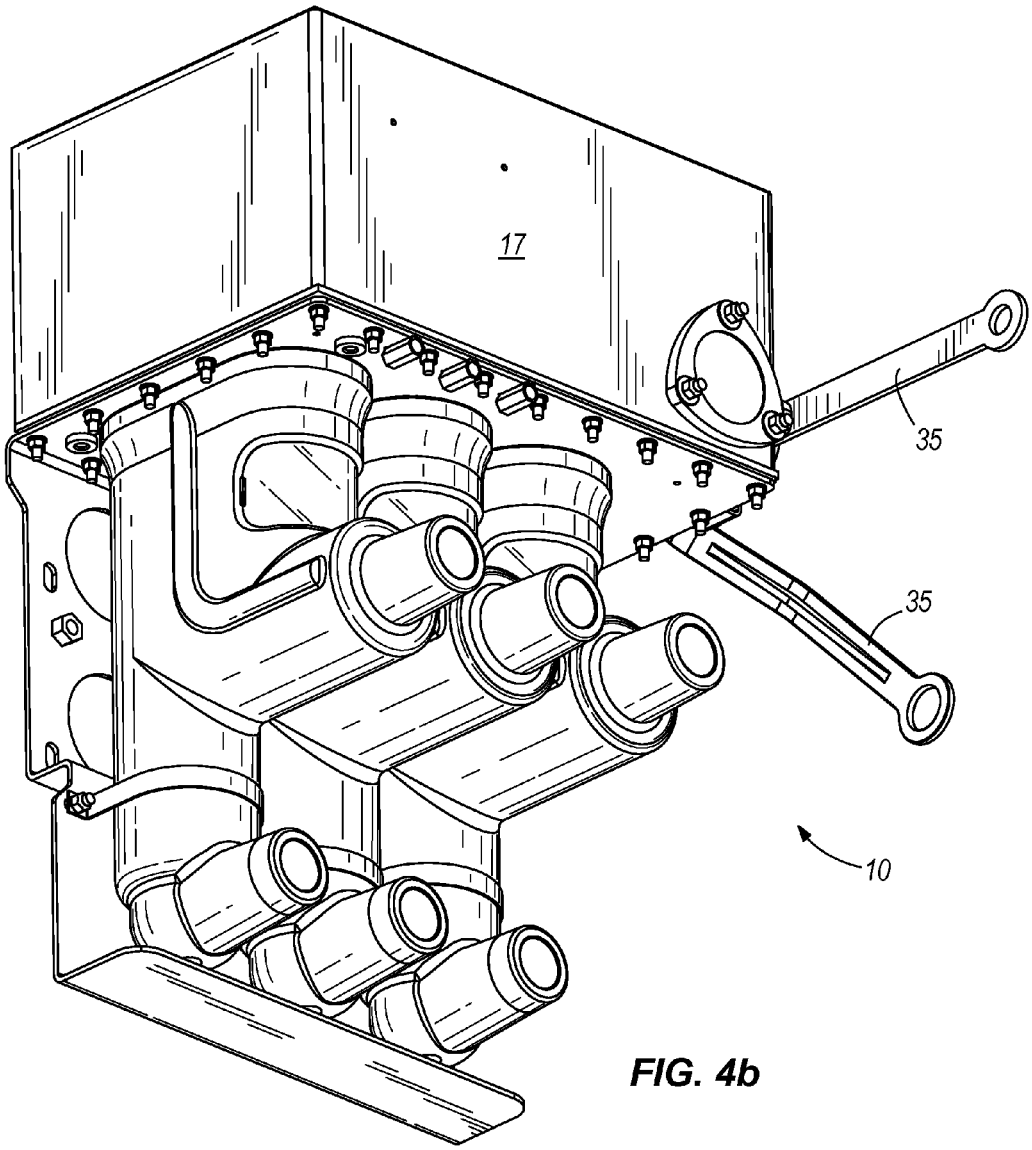
FIGS. 4*b*-4*d* are perspective views of the switch of FIG. 1 coupled to a gearbox.
Figure 4C:
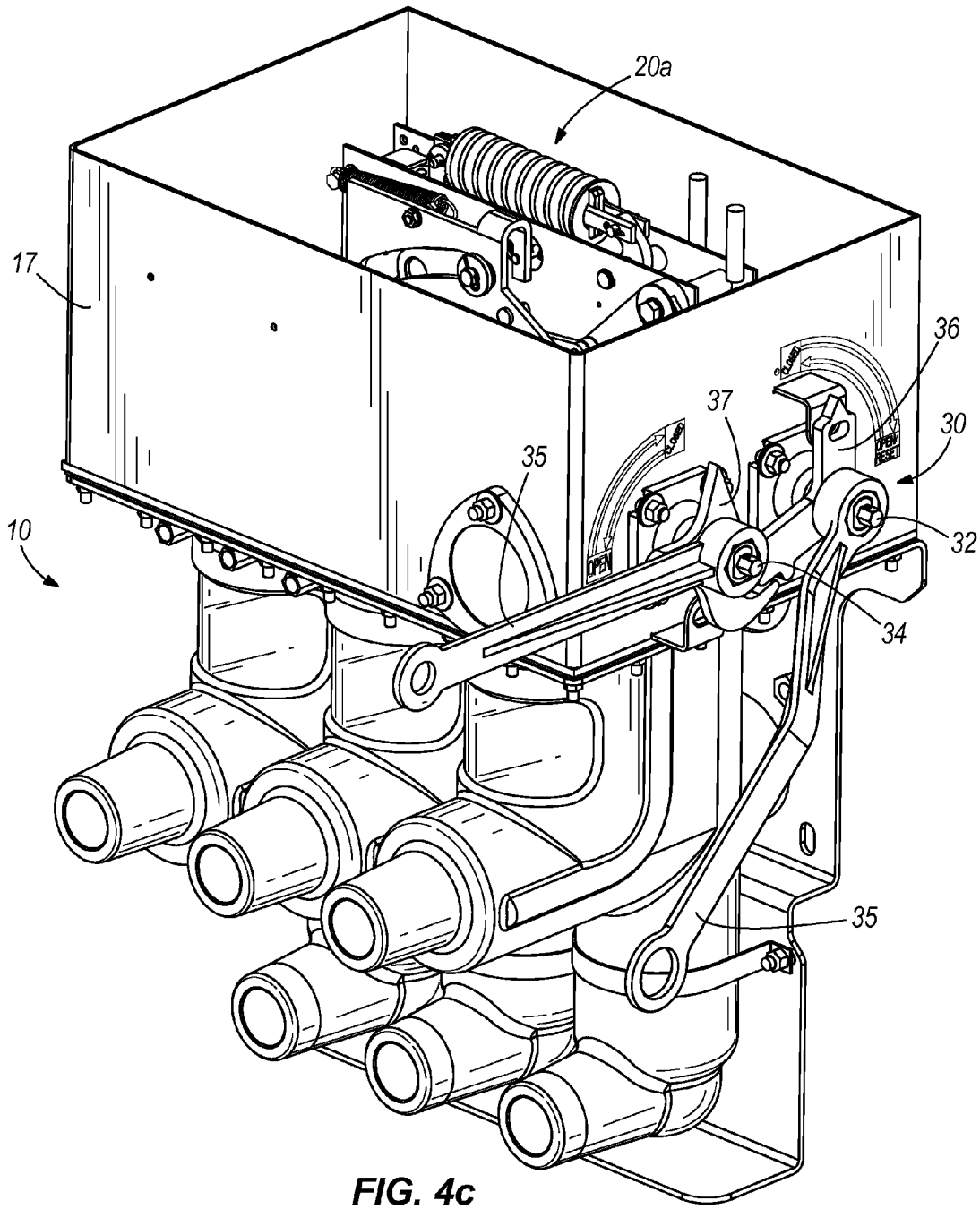
Figure 4D:
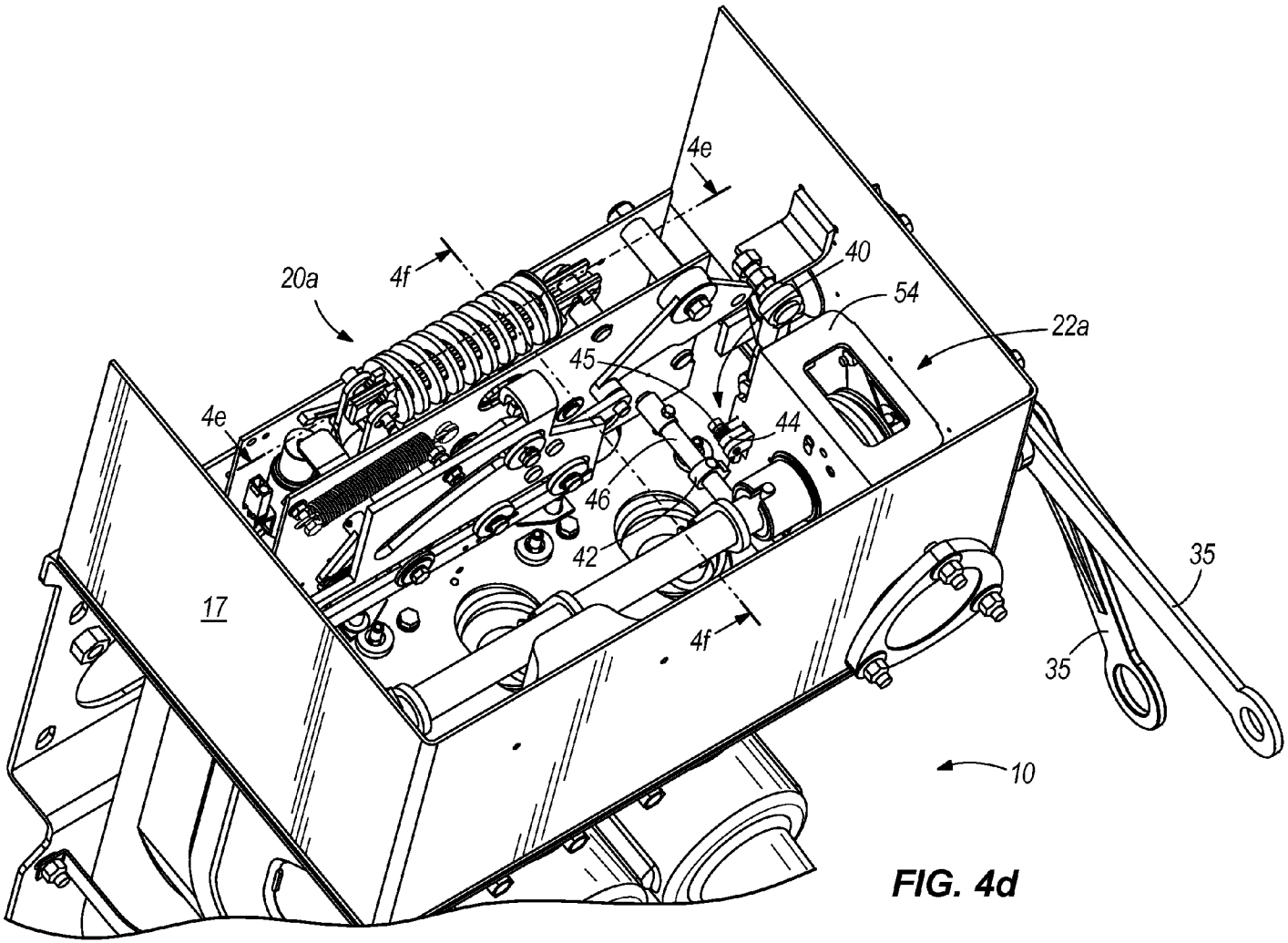
Figure 4E:
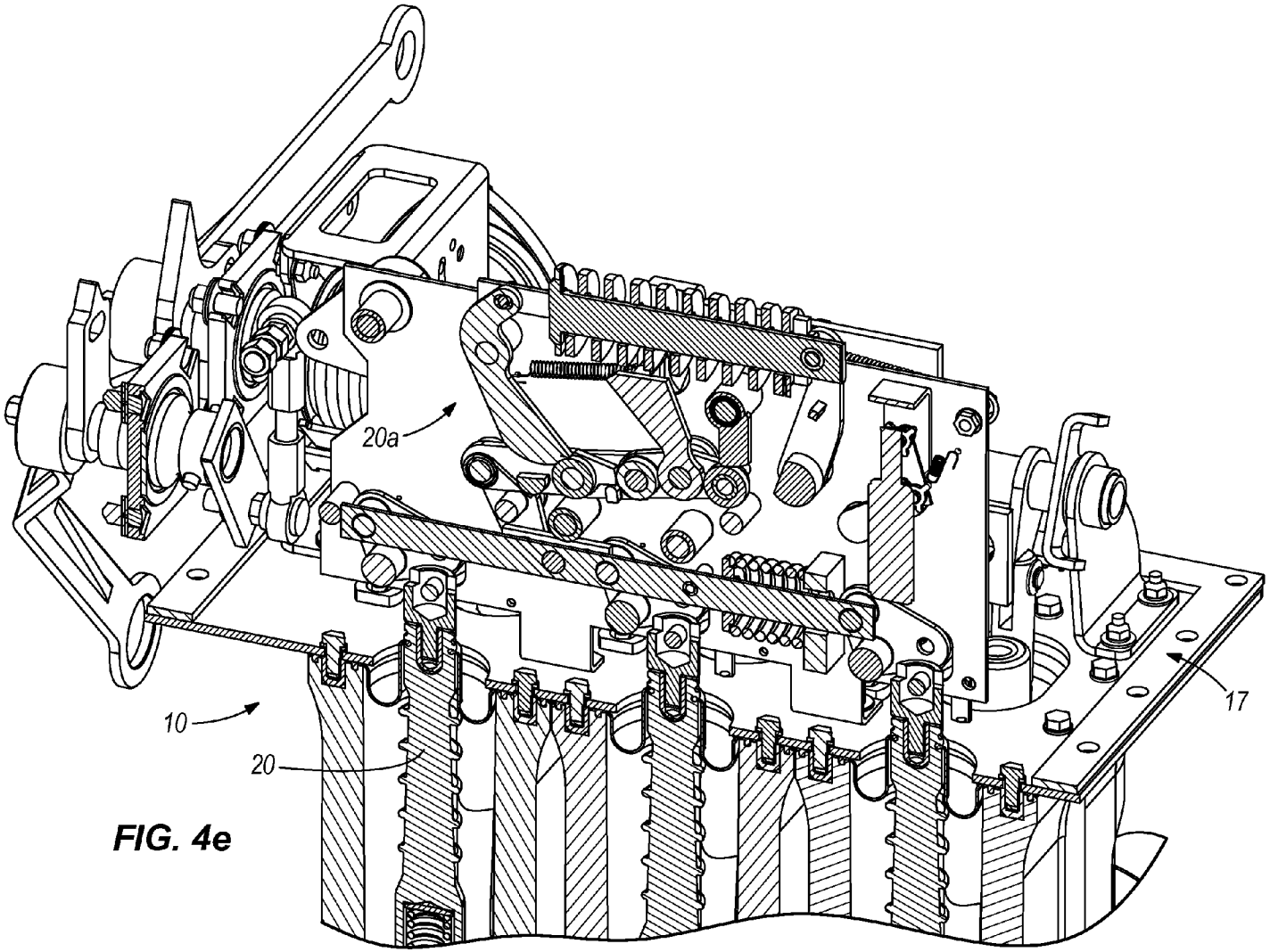
FIG. 4*e* is a cross-sectional view of the switch of FIG. 1 coupled to the gearbox, taken along line 4*e* illustrated in FIG. 4*d*.
Figure 4F:
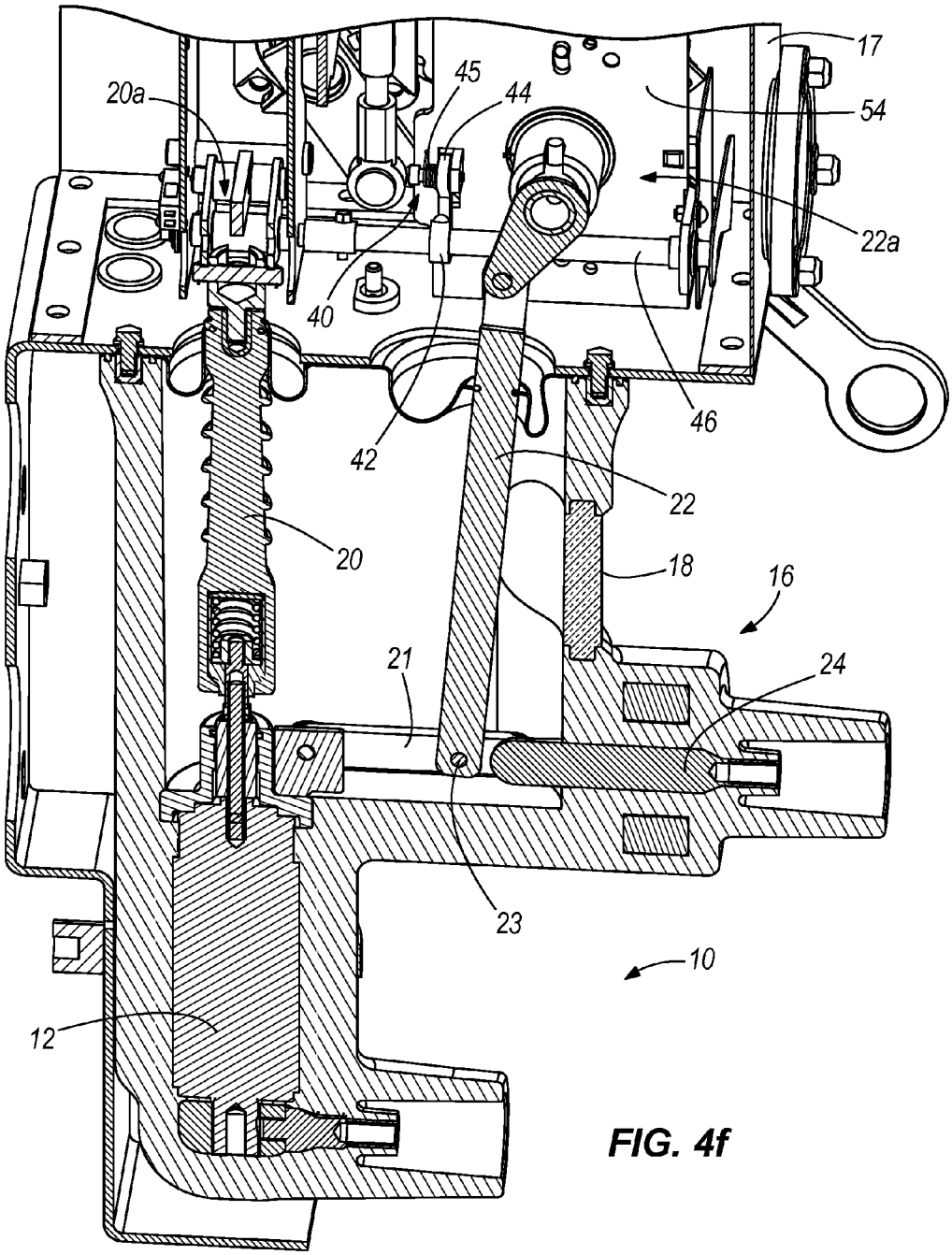
FIG. 4*f* is a cross-sectional view of the switch of FIG. 1 coupled to the gearbox, taken along line 4*f* illustrated in FIG. 4*d*.

In various embodiments, the vacuum interrupter operating mechanism 20 extends out of a top of the switch 10 (see FIG. 4*a*) and extends into a gearbox 17 coupled to the top of the switch 10 (see FIGS. 4*e* and 4*f*). As shown in FIGS. 4*b*-4*f*, the gearbox 17 includes an assembly 20*a* that controls movement of the mechanism 20 and can coordinate the movement of multiple mechanisms 20 when multiple switches 10 are used to control multiple power lines, e.g. for two- or three-phase power (e.g. see FIG. 4*e*). The assembly 20*a* can include a plurality of components for controlling movement of the vacuum interrupter operating mechanism 20. For example, as shown in FIG. 4*c*, the assembly 20*a* includes an extension 32 that can be driven or moved (e.g., rotated) by an operator or an automated controller. In some embodiments, a lever or a handle 35 can be connected to the extension 32 to aid an operator or an automated controller in rotating the extension 32. The assembly 20*a* can also include a rotatable shaft that translates rotation of the extension 32 to the vacuum interrupter operating mechanism 20. Various additional components, such as springs, linkages, couplings, pins, plates, frames, and additional shafts, can also be included in the assembly 20*a* and used to translate rotation of the extension 32 into movement of the vacuum interrupter operating mechanism 20, as is well known in the industry.

The visible disconnect 14 is connected in series with the vacuum interrupter 12. The visible disconnect 14 illustrated in FIGS. 1-3 includes a knife blade assembly that includes a blade 21 and a visible disconnect operating mechanism 22. The operating mechanism 22 can be operated manually or in an automated fashion to move the blade 21 between a closed state (see FIGS. 1 and 2) and an open state (see FIG. 3). For example, in some embodiments, the visible disconnect operating mechanism 22 pivots the blade 21 on a pin 23 or other pivoting mechanism between the two states. In the closed state, the blade 21 physically and electrically connects the vacuum interrupter 12 with a source conductor 24. In the open state, the blade 21 physically and electrically disconnects the vacuum interrupter 12 from the source conductor 24. Therefore, the physical position of the blade 21 can be used to visually inspect whether the vacuum interrupter 12 is physically and, consequently, electrically connected to the source conductor 24. Therefore, the physical position of the blade 21 provides visual verification to an operator regarding whether current may be flowing through the switch 10.

As shown in FIG. 4*a*, the visible disconnect operating mechanism 22 extends out of a top of the switch 10 and extends into the gearbox 17 coupled to the top of the switch 10 (see FIGS. 4*e* and 4*f*). As shown in FIGS. 4*b*-4*f*, the gearbox 17 includes an assembly 22*a* that controls movement of the mechanism 22 and can coordinate the movement of multiple mechanisms 22 when multiple switches 10 are used to control multiple power lines, e.g. for two- or three-phase power (e.g. see FIG. 4*e*). The assembly 22*a* can include a plurality of components for controlling movement of the visible disconnect operating mechanism 22. For example, as shown in FIG. 4*c*, the assembly 22*a* includes an extension 34 that can be driven or moved (e.g., rotated) by an operator or an automated controller. In some embodiments, a lever or a handle 35 can be connected to the extension 34 to aid an operator or an automated controller in rotating the extension 34. The assembly 22*a* can also include a rotatable shaft that translates rotation of the extension 34 into movement of the visible disconnect operating mechanism 22. Various additional components, such as springs, linkages, couplings, pins, plates, frames, and additional shafts, can also be included in the assembly 22*a* and used to translate rotation of the extension 34 into movement of the visible disconnect operating mechanism 22, as is well known in the industry.

Figure 5:
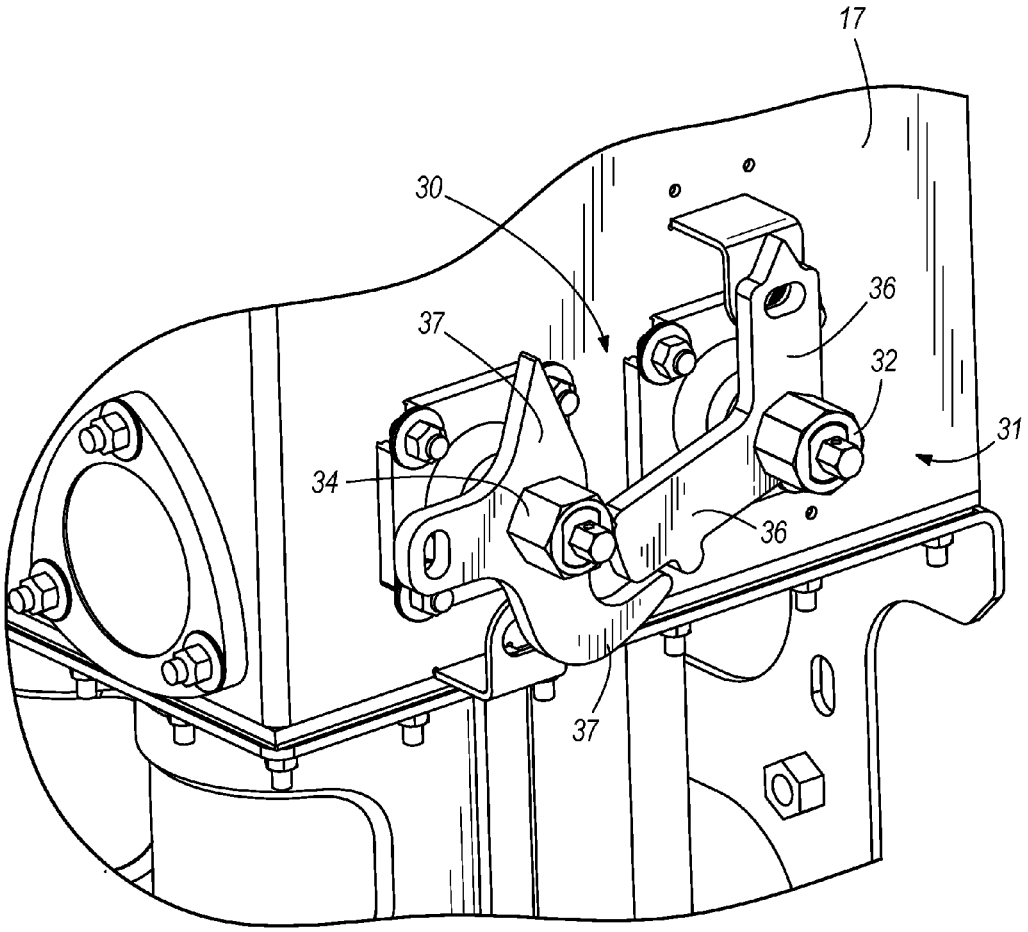
FIG. 5 is a perspective view of an external interlock system for the switch of FIG. 1, shown in a locked position.
Figure 6A:
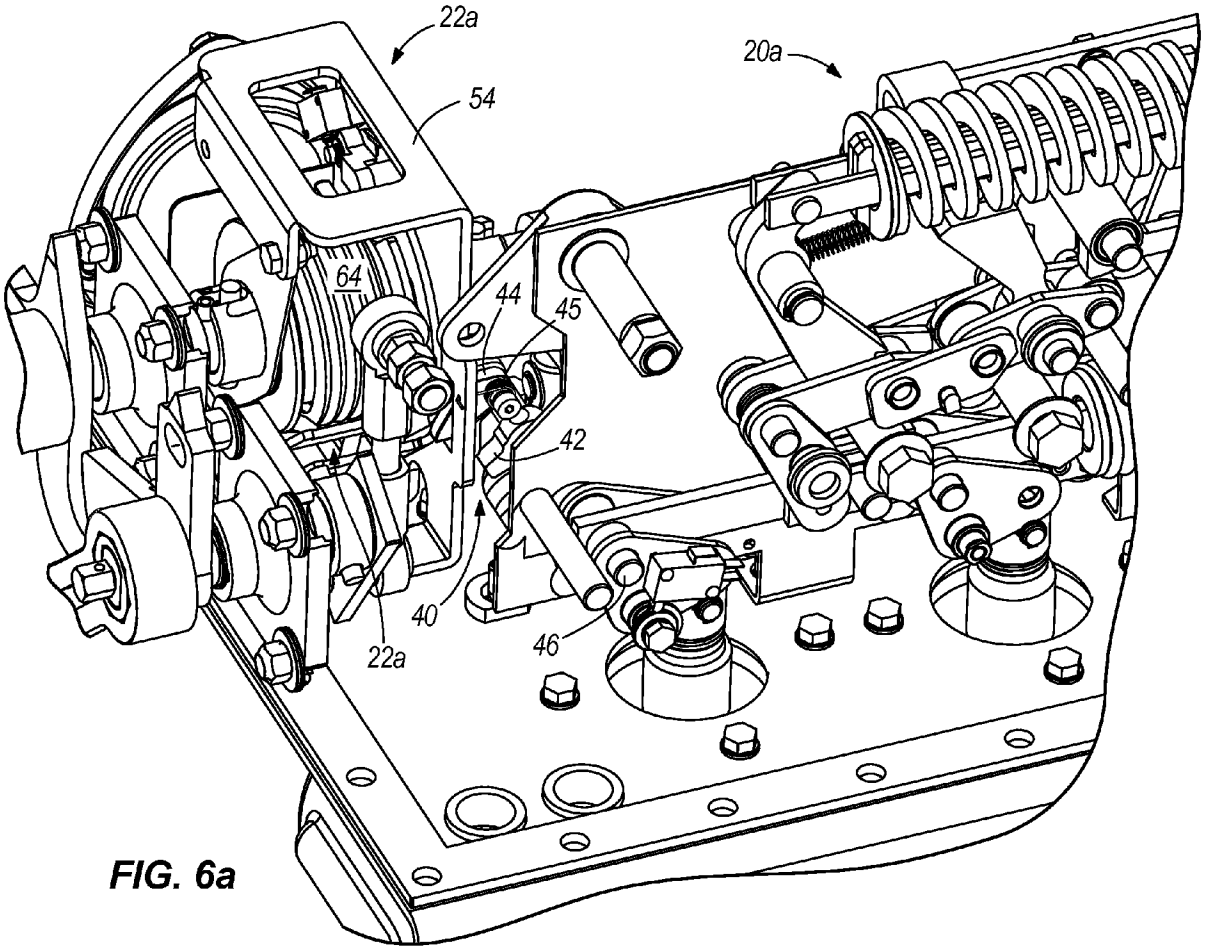
FIGS. 6*a*-6*b* are perspective views of an internal interlock system for the switch of FIG. 1.
Figure 6B:
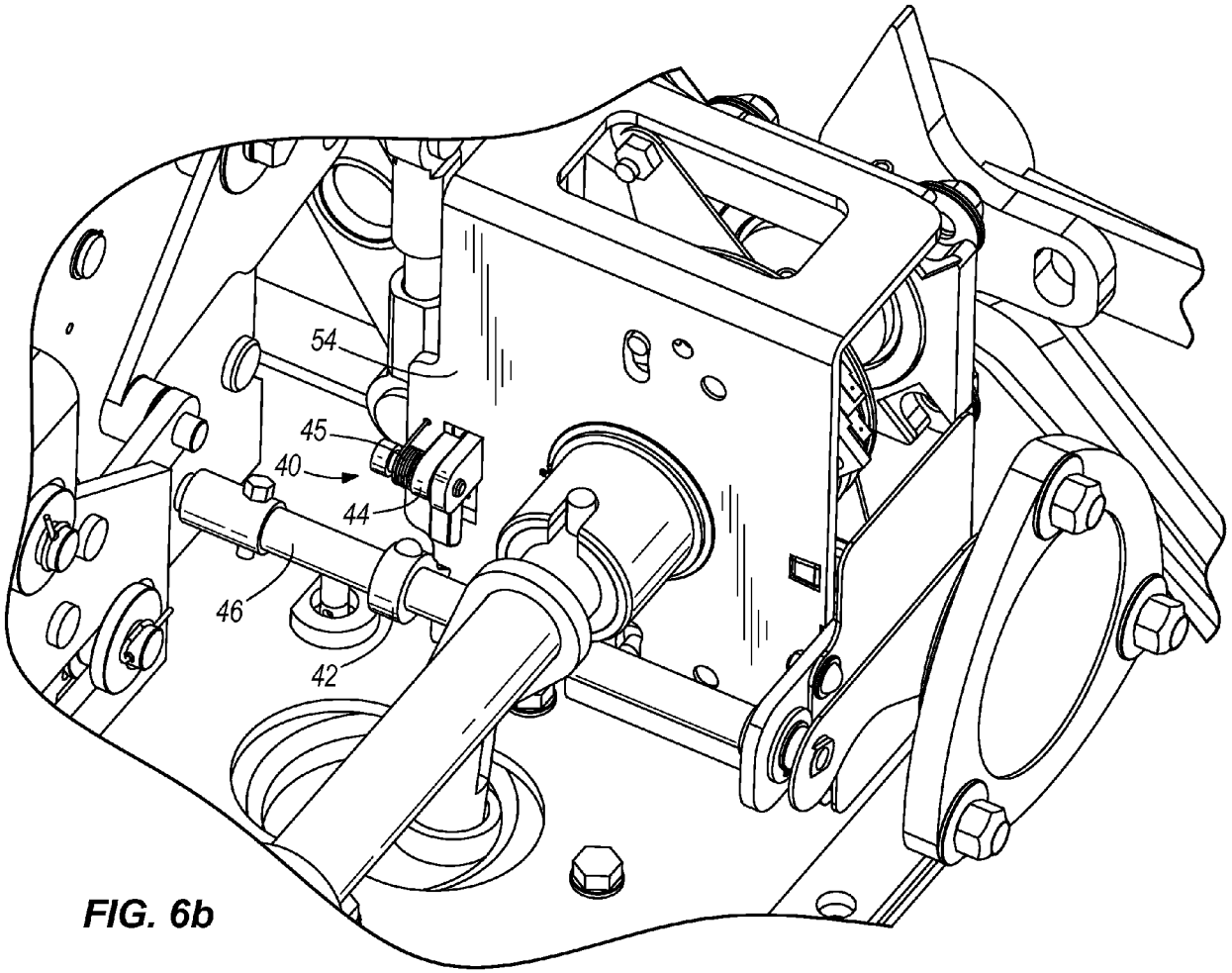

As described above, to prevent unsafe arcing, the vacuum interrupter 12 must be opened before the visible disconnect 14 can be opened or closed. To coordinate this required operational sequence, the switch 10 can include (as shown in FIG. 5) an external interlock system 30. The external interlock system 30 is mounted to an external wall 31 of the gearbox 17. As illustrated in FIGS. 4*c* and 5, the external interlock system 30 includes a cam piece 36 associated with the first extension 32 and a cam piece 37 associated with the second extension 34. The cam pieces 36, 37 rotate with the extensions 32, 34, respectively, and the shape and placement of the cam pieces 36, 37 mechanically require that an operator move (e.g., rotate) the first extension 32 before the operator can move (e.g., rotate) the second extension 34. In particular, as shown in FIG. 4*c*, the shape of the cam piece 36 blocks the cam piece 37 and the associated second extension 34 from rotating until the first extension 32 and the cam piece 36 are rotated to an open position. Therefore, due to the configuration of the cam pieces 36, 37, an operator (e.g., either manually or in an automated fashion) must open the vacuum interrupter 12 before the operator can change the state of the visible disconnect 14. This operational sequence ensures that all of the load-breaking occurs in the vacuum interrupter 12 rather than in the visible disconnect 14.

As noted above, in some embodiments, even if an operator uses the assembly 20*a* to open the vacuum interrupter 12 (i.e., rotates the first extension 32), the second contact 19*b* may not be displaced from the first position $P_1$ to the second position $P_2$ (e.g., due to a malfunction in the operating mechanism 20 or due to the contacts 19*a* and 19*b* being welded together). In this situation, it is unsafe to allow an operator to change the state of the visible disconnect 14. The external interlock system 30 described above, however, will not, by itself, prevent the operator from changing the state of the visible disconnect 14 in this situation. Rather, as long as the operator has moved the first extension 32 (which rotates the cam piece 36 to a position where it no longer blocks rotation of the cam piece 37 and the associated second extension 34), the external interlock system 30 allows the operator to move the second extension 34 to change the state of the visible disconnect 14.

To address this concern, the switch 10 includes an internal interlock system 40 (see FIGS. 4*d*, 4*f*, 6*a*, and 6*b*). As shown in FIGS. 4*d*, 4*f*, 6*a*, and 6*b*, the internal interlock system 40 is positioned inside the gearbox 17. Therefore, as compared to the external interlock system 30, the internal interlock system 40 is invisible to an operator, which can prevent an operator from disabling or by-passing the internal interlock system 40. The internal interlock system 40 operates independently of the external interlock system 30 and the extensions 32, 34 controlling the assemblies 20*a*, 22*a*. As described in more detail below, the internal interlock system 40 prevents actuation of the assembly 22*a* associated with the visible disconnect 14 through the second extension 34 until the vacuum interrupter 12 is open (i.e., until the second contact 19*b* is in the second position $P_2$) independent of the operation of the extensions 32, 34 and the external interlock system 30. In particular, the internal interlock system 40 mechanically prevents at least one component of the assembly 22*a* from moving and changing the state of the visible disconnect 14 until the vacuum interrupter 12 is open.

Figure 7A:
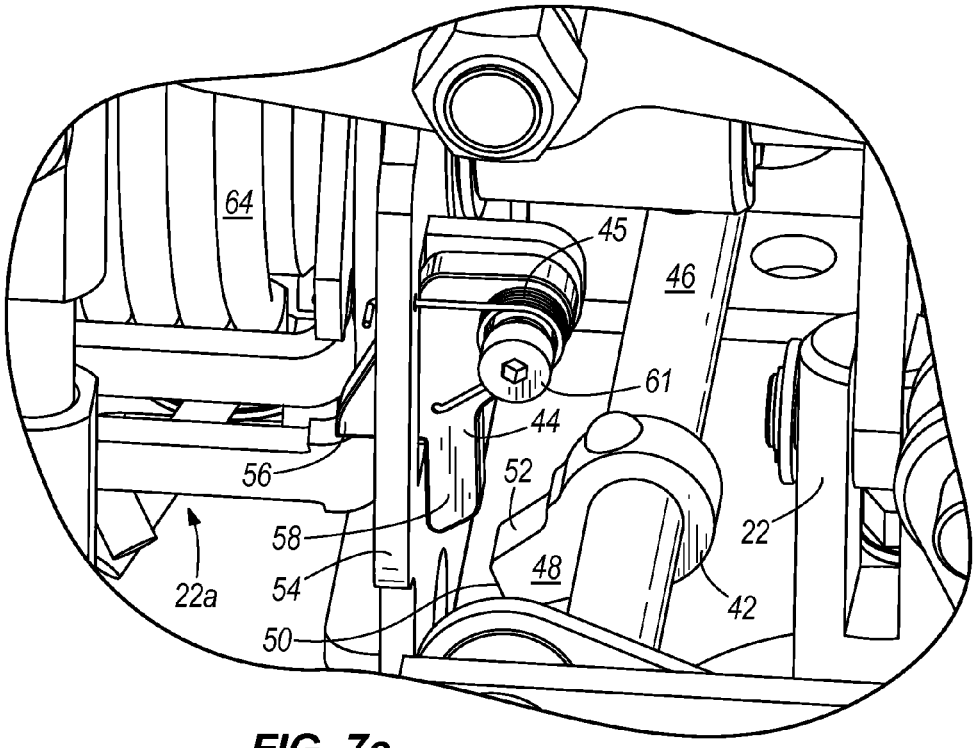
FIG. 7*a* is a side view of the internal interlock system.
Figure 7B:
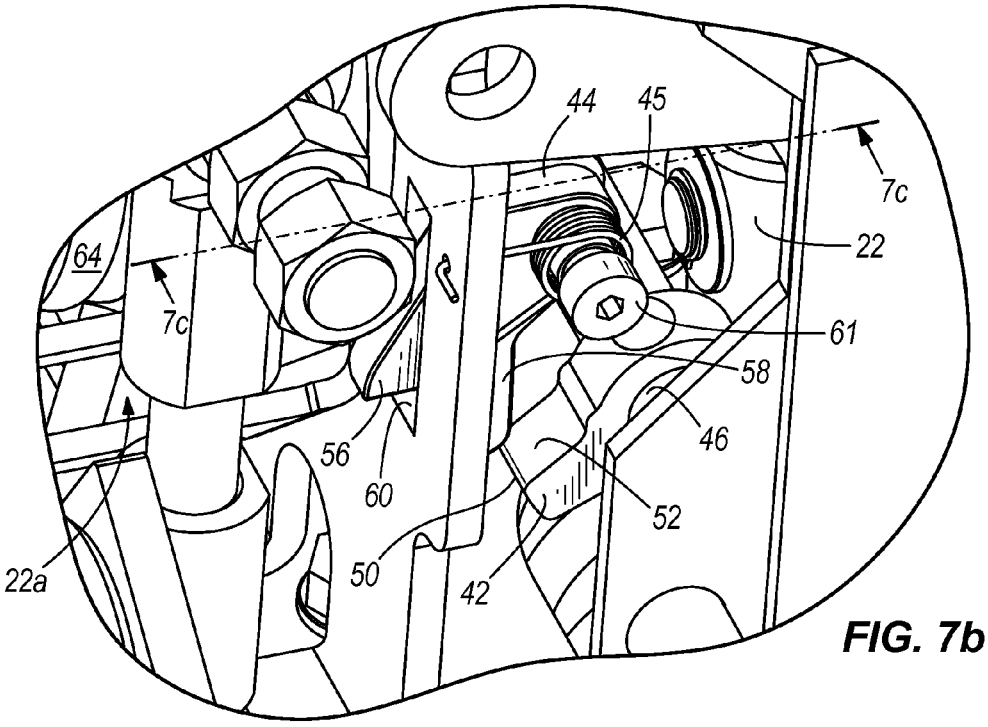
FIG. 7*b* is a perspective view of the internal interlock system.
Figure 7C:
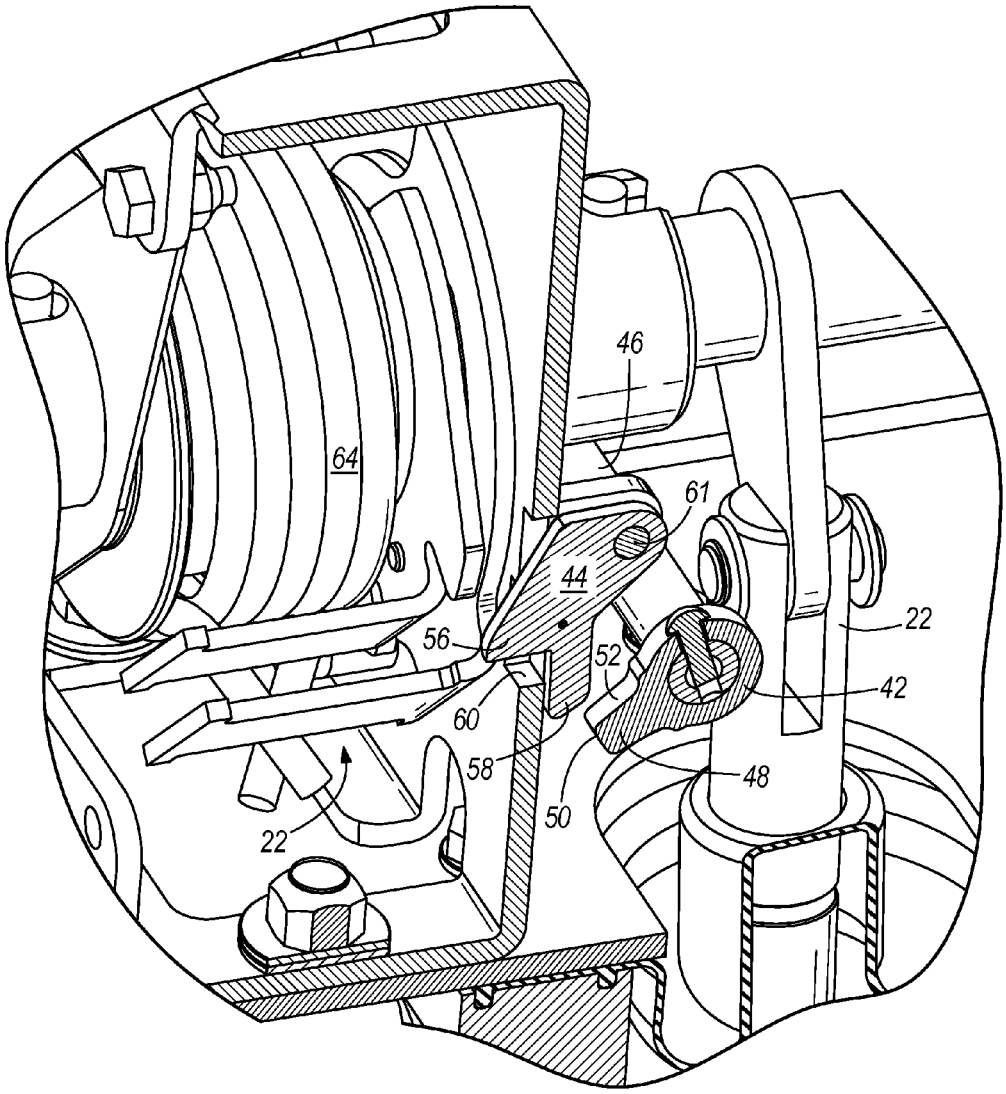
FIG. 7*c* is a cross-sectional view of the internal interlock system, taken along line 7*c* illustrated in FIG. 7*b*.

FIGS. 7*a* through 7*c* illustrate the internal interlock system 40 in greater detail. As shown in FIGS. 7*a* through 7*c*, the internal interlock system 40 includes a cam 42 and a bias-driven follower 44 (e.g., biased by a spring 45). The bias-driven follower 44 is attached to a frame 54 that at least partially encloses at least a portion of the assembly 22*a*. The cam 42 is coupled to a shaft 46, which is driven by the position of the second contact 19*b* of the vacuum interrupter 12 through a link in the assembly 20*a* (see, e.g., FIG. 4*f*). Therefore, the shaft 46 drives the cam 42 between a first cam state when the vacuum interrupter 12 is in the open state (see FIG. 8) and a second cam state when the vacuum interrupter 12 is in the closed state (see FIG. 9).

As shown in FIGS. 7*a* through 7*c*, the cam 42 includes an actuation arm 48 that has a first contact surface 50 and a second contact surface 52. The first and second contact surfaces 50 and 52 of the actuation arm 48 can interact with the follower 44. The follower 44 includes a first portion 56 and a second portion 58. The first portion 56 of the follower 44 is movable through an opening 60 in the frame 54. The follower 44 is pivotable about a pin 61 or other pivoting mechanism between a first follower state (see FIG. 8) and a second follower state (see FIG. 9).

During operation, the internal interlock system 40 ensures that the operational sequence of the vacuum interrupter 12 and the visible disconnect 14 described above is maintained even in the situation where, although the operator has rotated the first extension 34 to drive the assembly 20*a* to open the vacuum interrupter 12, the vacuum interrupter 12 does not open (e.g., the operating mechanism 20 and/or the external interlock system 30 malfunctions or is improperly by-passed or the contacts 19*a* and 19*b* have become welded together).

Figure 9:
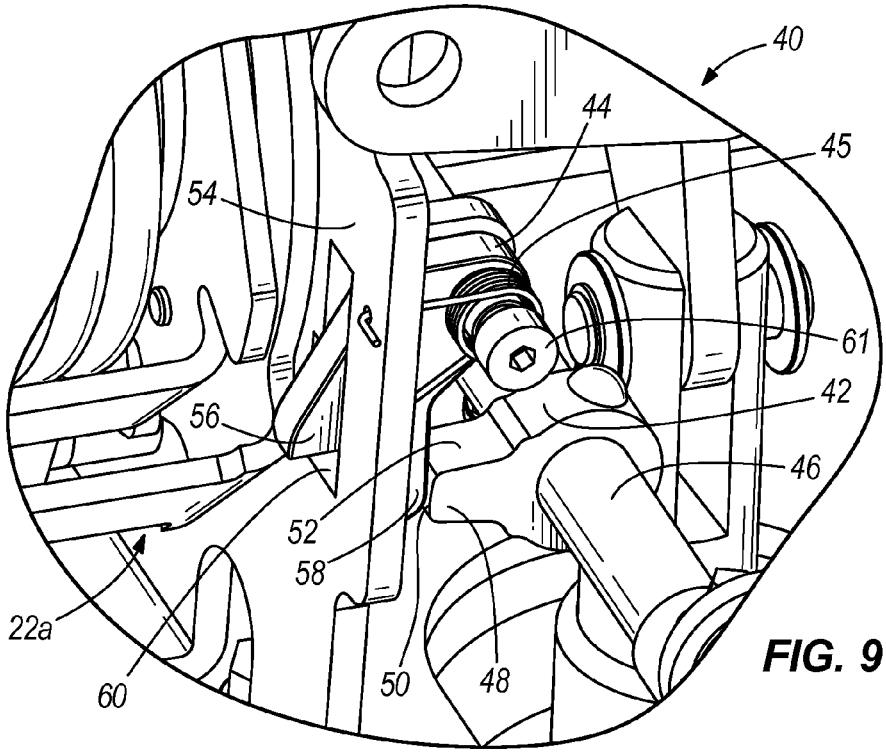
FIG. 9 is a perspective view of the internal interlock system, shown in a locked position.

For example, as described above, the visible disconnect operating mechanism 22 is movable to change the state of the visible disconnect 14 (i.e., open or close the visible disconnect 14). The visible disconnect operating mechanism 22 is coupled to the assembly 22*a* (see FIGS. 4*f* and 7*c*), which translates rotation of the second extension 34 into movement of the visible disconnect operating mechanism 22. However, as shown in FIG. 9, at least one component of the assembly 22*a* (e.g., a rotating plate controlled by a spring) may be blocked by the follower 44 when the internal interlock system 40 is engaged or placed in a locked state. The internal interlock system 40 is placed in the locked state when the contacts 19*a*, 19*b* of the vacuum interrupter 12 are not separated (i.e., the second contact 19*b* is not in the second position $P_2$).

In particular, when the contacts 19*a*, 19*b* of the vacuum interrupter are closed or connected (i.e., the second contact 19*b* is in the first position $P_1$), the shaft 46 rotates to position the cam 42 in the second cam state (i.e., a locked position), as shown in FIG. 9. With the cam 42 in the second cam state, the actuation arm 48 of the cam 42 is positioned such that the first contact surface 50 contacts the second portion 58 of the follower 44. With the first contact surface 50 contacting the second portion 58, the follower 44 is forced against its bias (against the spring 45) to the second follower state. As shown in FIG. 9, in the second follower state, the follower 44 is positioned such that the first portion 56 extends through the opening 60 in the frame 54 and blocks movement of at least one component of the assembly 22*a*. Under these conditions, the follower 44 allows the assembly 22*a* to be charged (e.g., allows a spring 64 associated with the assembly 22*a* to be charged), but prevents the release of energy needed to open the visible disconnect 14. This design ensures that the operator cannot put extra force on the cam 42 and the follower 44 (e.g., through the assembly 22*a*) that could override the internal interlock system 40.

Figure 8:
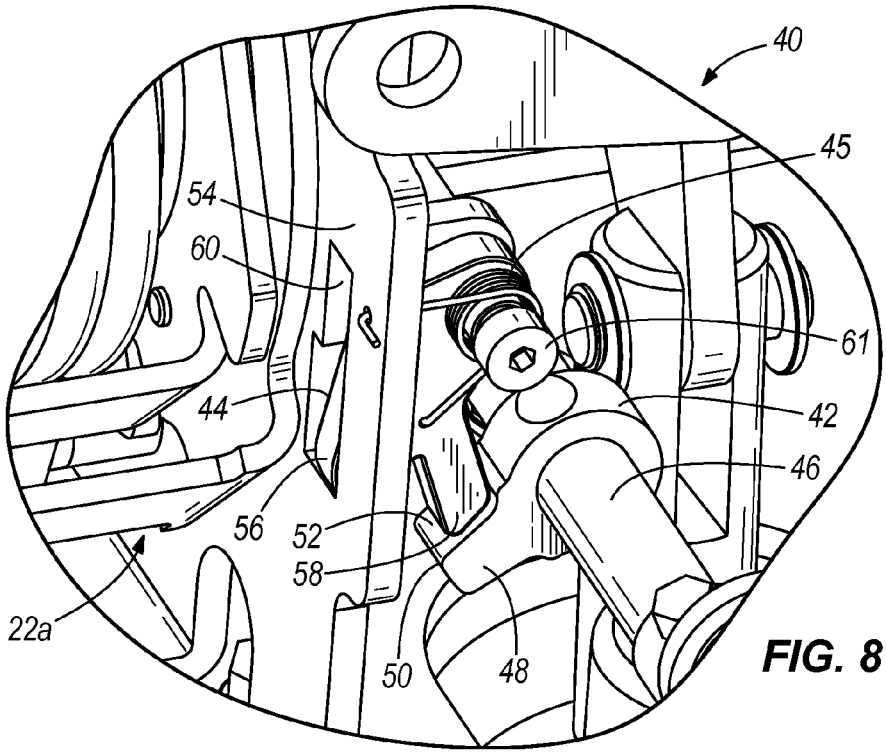
FIG. 8 is a perspective view of the internal interlock system, shown in an unlocked position.

Conversely, when the contacts 19*a*, 19*b* of the vacuum interrupter are open or separated (i.e., the second contact 19*b* is in the second position $P_2$), the shaft 46 rotates to position the cam 42 in the first cam state (i.e., an unlocked position), as shown in FIG. 8. With the cam 42 in the first cam state, the actuation arm 48 of the cam 42 is positioned such that the first contact surface 50 disengages from the second portion 58 of the follower 44, such that the cam 42 no longer forces the follower 44 against the bias (i.e., against the force of the spring 45). Therefore, the follower 44 rotates based on the force of the spring 45 to the first follower state (i.e., a resting state). In the first follower state, the second portion 58 of the follower 44 rests on the second contact surface 52 of the cam 42. As shown in FIG. 8, in the first follower state, the follower 44 is positioned such that the first portion 56 of the follower 44 no longer blocks movement of the at least one component of the assembly 22*a*.

Alternatively, in some embodiments, when the cam 42 is rotated by the shaft 46 into an unlocked position, the cam 42 no longer engages with the follower 44. For example, the shaft 46 can rotate the cam 42 into engagement with the follower 44 to engage or lock the internal interlock system 40 and can rotate the cam 42 out of engagement with the follower 44 to disengage or unlock the internal interlock system 40. In particular, when the cam 42 is in a locked position, the cam 42 contacts the second portion 58 of the follower 44 and pushes the second portion 58 against the frame 54 (but may not necessarily extend the first portion 56 further through the opening 60) and into a second follower state. In this state, the follower 44 is held rigidly against the frame 54 by the cam 42 such that follower 44 cannot move. With the follower 44 held in this rigid position, the first portion 56 of the follower 44 is positioned in the path of at least one movable component of the assembly 22*a* and, consequently, blocks movement of the component. Alternatively, when the cam 42 is in the unlocked position, the cam 42 is positioned such that it no longer contacts the follower 44 (see FIGS. 7*a*-7*c*), and the follower 44 assumes the first follower state (i.e., a resting state) where it can freely rotate on the pivot 61. In this state, when the at least one component of the assembly 22*a* attempts to move (e.g., rotates), the component pushes on the first portion 56 of the follower 44, which causes the follower 44 to pivot and move out of the way of the component. Accordingly, when the cam 42 is in an unlocked position, the assembly 22*a* can push the follower 44 out of the way because the follower 44 is not restricted from rotating by the cam 42.

Therefore, to properly open the vacuum interrupter 12 and in turn, to properly open the visible disconnect 14, an operator uses the assembly 20*a* (e.g., via the first extension 32) to move the vacuum interrupter mechanism 20, which changes the vacuum interrupter 12 from the closed to the open state (i.e., moves the second contact 19*b* from the first position $P_1$ to the second position $P_2$). As described above, the separation of the second contact 19*b* from the first contact 19*a* rotates the shaft 46, which moves the cam 42 of the internal interlock system 40 to the unlocked state. In the unlocked state, the follower 44 assumes the first follower state where it no longer blocks movement of the at least one component of the assembly 22*a*. Therefore, the operator can use the assembly 22*a* to open the visible disconnect 14 (i.e., by rotating the second extension 34). In the open state, the blade 21 of the visible disconnect 14 disconnects the vacuum interrupter 12 from the source conductor 24 and provides visual verification to an operator that the circuit is open (i.e., vacuum interrupter 12 is physically and electrically disconnected from the source conductor 24).

Similarly, to reestablish a working circuit in the switch 10 after the vacuum interrupter 12 has been opened, an operator first uses the assembly 22*a* to close the visible disconnect 14 (e.g., by rotating the extension 34). With the visible disconnect 14 in the closed state, the blade 21 of the visible disconnect 14 physically and electrically connects the vacuum interrupter 12 with the source conductor 24. After the visible disconnect 14 has been closed, the operator can use the assembly 20*a* (e.g., the first extension 32) to close the vacuum interrupter 12 (i.e., to move the second contact 19*b* of the vacuum interrupter 12 from the second position $P_2$ to the first position $P_1$). When the vacuum interrupter 12 is closed, the shaft 46 rotates the cam 42 to engage the follower 44 and block movement of at least one component of the assembly 22*a*. Therefore, with the internal interlock system 40 engaged, the visible disconnect 14 cannot be changed to the open state using the assembly 22*a*.

The sequences of events defined by the interlock systems 30 and 40 ensure that the visible disconnect 14 is only in the open state when the circuit is broken (i.e., when the second contact 19*b* in the second position $P_2$).

It should be understood that the cam-and-follower configuration illustrated in the internal interlock 40 is only one configuration for preventing movement of at least one component of the assembly 22*a* when the vacuum interrupter 12 is not open. In particular, more or fewer components may be used to perform this function. Also the cam 42 and the follower 44 can take on other shapes and configurations, and the cam 42 and the follower 44 can be used to block movement of various components of the assembly 22*a* and/or the operating mechanism 22 itself. In addition, it should be understood that although the terms "internal" and "external" have been used to describe the interlock systems 30 and 40, these systems can be placed at various locations of the switch 10 and the gearbox 17 and, in some embodiments, may both be internal or may both be external to the gearbox 17.

It should also be understood that the internal interlock system 40 can be used without also using the external interlock system 30. For example, because the internal interlock system 40 blocks movement of at least one component of the assembly 22*a* operating the visible disconnect operating mechanism 22 unless the second contact 19*b* of vacuum interrupter 12 is in the second position $P_2$, the internal interlock system 40 provides a similar safety system as the external interlock system 30. Furthermore, because the internal interlock system 40 is located inside the gearbox 17, the system 40 is less likely to be by-passed or disabled by operators. However, the external interlock system 30 may be used in conjunction with the internal interlock system 40 to provide visual reminders to an operator regarding the operational sequence required to open or close the circuit (e.g., via the cam pieces 36, 37). Furthermore, using the two interlock systems 30 and 40 may provide additional diagnostic information to an operator regarding the switch 10. For example, if the operator has rotated the extension 32 to open the vacuum interrupter 12 but the internal interlock system 40 continues to prevent movement of the assembly 22*a*, including the second extension 34, the operator knows the switch 10 is malfunctioning (e.g., the contacts 19*a* and 19*b* might have become welded together) and that maintenance is required.

While the invention is described in terms of several preferred embodiments of circuit or fault interrupting devices, it will be appreciated that the invention is not limited to circuit interrupting and disconnect devices. The inventive concepts may be employed in connection with any number of devices including circuit breakers, reclosers, and the like. Also, it should be understood that the switch 10 can include a single-phase interrupting device or a multi-phase (e.g., a three phase) interrupting device.

Various features and advantages of the invention are set forth in the following claims.

What is claimed is:

1. A circuit-interrupting device comprising:

a load-breaker including a first contact and a second contact, the second contact movable between a first position $P_1$ and a second position $P_2$, a first operating mechanism for actuating movement of the second contact;

a first assembly for controlling movement of the first operating mechanism, the first assembly including a first extension movable to operate the first assembly;

a visible disconnect in series with the load-breaker, the visible disconnect having an open state and a closed state;

a second operating mechanism for actuating the visible disconnect between the open state and the closed state;

a second assembly for controlling movement of the second operating mechanism, the second assembly including a second extension movable to operate the second assembly; and an interlock system preventing movement of at least one component of the second assembly when the second contact is not in the second position $P_2$, the interlock system operating independently of the first extension and the second extension.

2. The circuit-interrupting device of claim 1, wherein the interlock system comprises a cam and a follower.

3. The circuit-interrupting device of claim 2, wherein the cam prevents movement of the at least one component of the second assembly by forcing the follower against a bias to block movement of the at least one component of the second assembly.

4. The circuit-interrupting device of claim 2, wherein the cam allows movement of the at least one component of the second assembly when the second contact is in the second position $P_2$.

5. The circuit-interrupting device of claim 1, wherein the interlock system is positioned within a gearbox of the circuit-interrupting device.

6. A circuit-interrupting device comprising:

a gearbox;

a visible disconnect;

a load-breaker in series with the visible disconnect;

a first operating mechanism for actuating the load-breaker between an open state and a closed state;

a second mechanism for actuating the visible disconnect between an open state and a closed state;

a first assembly controlling movement of the first operating mechanism;

a second assembly controlling movement of the second operating mechanism;

an interlock system external to the gearbox, the external interlock system coordinating operation of the first assembly and the second assembly; and an interlock system internal to the gearbox, the internal interlock system including:

a cam driven by a shaft between a first cam state when the load-breaker is in the open state and a second cam state when the load-breaker is in the closed state; and a bias-driven follower having a first follower state when the cam is in the first cam state and having a second follower state when the cam is in the second cam state, the bias-driven follower blocking movement of at least one component of the second assembly when the bias-driven follower is in the second follower state.

7. The circuit-interrupting device of claim 6, wherein the internal interlock system operates independently of the external interlock system.

8. The circuit-interrupting device of claim 6, wherein the external interlock system includes a first cam piece associated with the first assembly and a second piece associated with the second assembly, the first cam piece and the second cam piece shaped to prevent operation of the second assembly to move the visible disconnect to the open state until the first assembly has been operated to move the load-breaker to the open state.

9. The circuit-interrupting device of claim 8, wherein the first cam piece and the second cam piece prevent the operation of the first assembly to move the load-breaker to the closed state until the second assembly has been operated to move the visible disconnect to the closed state.

10. The circuit-interrupting device of claim 6, wherein the cam comprises an actuation arm having a first contact surface and a second contact surface.

11. The circuit-interrupting device of claim 10, wherein the bias-driven follower comprises a first portion and a second portion.

12. The circuit-interrupting device of claim 11, wherein the first portion and the second portion of the follower pivot about pin.

13. The circuit-interrupting device of claim 11, wherein the first portion of the bias-driven follower is movable through an opening in a frame.

14. The circuit-interrupting device of claim 11, wherein when the cam is in the first cam state, the first contact surface of the actuation arm disengages the second portion of the bias-driven follower, the bias-driven follower rotates to the first follower position where the second portion of the bias-driven follower rests on the second contact surface and allows movement of the at least one component of the second assembly.

15. The circuit-interrupting device of claim 14, wherein when a second contact of the load-breaker is in a second position $P_2$, the cam is driven by the shaft into the first cam state.

16. The circuit-interrupting device of claim 11, wherein when the cam is in the second cam state, the first contact surface of the actuation arm engages the second portion of the bias-driven follower and rotates the bias-driven follower into the second follower state where the first portion of the bias-driven follower blocks movement of the at least one component of the second assembly.

17. The circuit-interrupting device of claim 16, wherein when a second contact of the load-breaker is in a first position $P_1$, the cam is driven by the shaft into the second cam state.

18. The circuit-interrupting device of claim 16, wherein when the bias-driven follower is in the second follower state, the bias-driven follower allows a spring of the second assembly to be charged.

19. An interlock system for a circuit-interrupting device, the circuit-interrupting device including a gearbox, a load-breaker in series with a visible disconnect, and an assembly driving the visible disconnect between an open state and a closed state, the interlock system comprising:

a cam coupled to a shaft and driven by the shaft between a first cam state when the load-breaker is in an open state and a second cam state when the load-breaker is in a closed state; and a bias-driven follower having a first follower state when the cam is in the first cam state and having a second follower state when the cam is in the second cam state, in the second follower state the bias-driven follower blocking movement of at least one component of the assembly, wherein the cam and the bias-driven follower are internal to the gearbox.

20. The interlock system of claim 19, wherein the cam comprises an actuation arm having a first contact surface and a second contact surface.

21. The interlock system of claim 20, wherein the bias-driven follower comprises a first portion and a second portion.

22. The interlock system of claim 21, wherein the first portion and the second portion of the bias-driven follower pivot about a pin.

23. The interlock system of claim 21, wherein the first portion of the bias-driven follower is movable through an opening in a frame.

24. The interlock system of claim 21, wherein when the cam is in the first cam state, the first contact surface of the actuation arm disengages the second portion of the bias-driven follower and the bias-driven follower rotates to the first follower position where the second portion of the bias-driven follower rests on the second contact surface and allows movement of the at least one component of the assembly.

25. The interlock system of claim 24, wherein when a first contact and a second contact of the load-breaker are separated, the cam is driven by the shaft into the first cam state.

26. The interlock system of claim 21, wherein when the cam is in the second cam state, the first contact surface of the actuation arm engages the second portion of the bias-driven follower to rotate the bias-driven follower to the second follower position where the first portion of the bias-driven follower blocks movement of the at least one component of the assembly.

27. The interlock system of claim 26, wherein when a first contact and a second contact of the load-breaker are not separated, the cam is driven by the shaft into the second cam state.

28. The interlock system of claim 26, wherein when the bias-driven follower is in the second follower state, the bias-driven follower allows at least one spring of the assembly to be charged.

* * * * *